US007340880B2

(12) United States Patent
Magoshi et al.

(10) Patent No.: US 7,340,880 B2
(45) Date of Patent: Mar. 11, 2008

(54) COMPRESSED AIR BYPASS VALVE AND GAS TURBINE

(75) Inventors: Ryotaro Magoshi, Takasago (JP); Masaru Nishikatsu, Kobe (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 571 days.

(21) Appl. No.: 10/480,639

(22) PCT Filed: Jun. 24, 2002

(86) PCT No.: PCT/JP02/06283

§ 371 (c)(1),
(2), (4) Date: Jul. 22, 2004

(87) PCT Pub. No.: WO03/001118

PCT Pub. Date: Jan. 3, 2003

(65) Prior Publication Data

US 2004/0255570 A1 Dec. 23, 2004

(30) Foreign Application Priority Data

Jun. 26, 2001 (JP) ..... 2001-193186

(51) Int. Cl.
*F02C 9/00* (2006.01)
*F23R 3/26* (2006.01)

(52) U.S. Cl. ..... 60/39.23; 60/785; 60/794; 60/39.37

(58) Field of Classification Search ..... 60/39.23, 60/785, 794, 795, 39.37, 752; 431/351
See application file for complete search history.

(56) References Cited

U.S. PATENT DOCUMENTS 4,785,624 A * 11/1988 Smith et al. ..... 60/806
5,557,920 A 9/1996 Kain
6,226,977 B1 * 5/2001 Ichiryu et al. ..... 60/39.23

FOREIGN PATENT DOCUMENTS

JP 59-56022 3/1984
JP 10-26353 1/1998
JP 10-026353 * 1/1998

* cited by examiner

*Primary Examiner*—Ted Kim
(74) *Attorney, Agent, or Firm*—Oblon, Spivak, McClelland, Maier & Neustadt, P.C.

(57) ABSTRACT

It is the objective of the present invention to enable smooth rotation of the grid plate and normal operation of the bypass valve, regardless of the operational state of the gas turbine. The bypass valve according to the present invention is provided with a frame, which is disposed to cover a plurality of compressed air introduction ports that are arrayed in ring, and in which there are formed a plurality of first openings that communicate with a combustion chamber tail pipe; a grid plate which has a ring shape identical to that formed by the plurality of combustion chamber tail pipes and in which there are formed a plurality of second openings that are positioned opposite the first openings, this grid plate being supported in a manner to enable rotation in its circumferential direction; an inner rail and an outer rail that are provided to the inside surface and the outside surface of the grid plate and are formed in a unitary manner with the frame; and a plurality of guide rollers that are provided to the grid plate, and that come into contact with either the inner rail or the outer rail depending on the circumstances and assist in the rotation of the grid plate.

4 Claims, 7 Drawing Sheets

COMPRESSED AIR BYPASS VALVE AND GAS TURBINE

BACKGROUND OF THE INVENTION

1. Field of the Invention

The present invention relates to a bypass valve that diverts a portion of the air that has been compressed by a compressor, during the process of guiding this compressed air to a combustion chamber. The present invention further relates to a gas turbine equipped with this bypass valve.

2. Description of the Related Art

In conventional gas turbines, stable start-up operating conditions and output adjustments are designed for by diverting a portion of the air compressed by a compressor during the process of guiding this compressed air to a combustion chamber. This type of operation is carried out by means of a bypass valve that is provided along the flow path of the compressed air.

A conventional bypass valve and its surrounding structures are shown in FIG. 7. In this figure, reference number 1 indicates a combustion chamber tail pipe; 2 is a bypass pipe that is provided branching off from combustion chamber tail pipe 1; and 3 is a bypass valve provided to bypass pipe 2. A plurality of these combustion chamber tail pipes 1 is provided surrounding the perimeter of the main turbine axis, which is not shown in the figure. A bypass pipe 2 is provided for each of this plurality of combustion chamber tail pipes 1, respectively.

The structure of bypass valve 3 is schematically shown in FIG. 8. In this figure, numeric symbol 4 indicates a frame that is disposed so as to cover the end of compressed air introduction ports that are arrayed in a ring at an interval and form the bypass pipes 2; 5 is a grid plate that forms a ring shape that is identical to the array of the bypass pipes 2; 6 is an inside rail provided on the inner surface of grid plate 5 and formed in a unitary manner with frame 4; and 7 indicates a plurality of guide rollers that are provided to grid plate 5, and come into contact with inner rail 6 and assist in the rotation of grid plate 5.

A plurality of first openings 4*a* are formed in frame 4, these first openings 4*a* communicating with the end of each bypass pipe 2. A plurality of second openings 5*a* are formed in grid plate 5 at positions opposite first openings 4*a* and communicating with first openings 4*a*.

In this bypass valve 3, when a tangential force is applied to grid plate 5 by an actuator, which is not shown in the figure, causing grid plate 5 to rotate, the position of second openings 5*a* on grid plate 5 changes relative to first openings 4*a*, such that the area of overlap between the two openings 4*a*, 5*a* varies. In other words, by rotating grid plate 5, it is possible to vary the amount of compressed air being bypassed for all bypass pipes 2.

During gas turbine starting and stop operations in a conventional bypass valve 3 having the design described above, smooth rotation of grid plate 5 can cease to occur due to the difference in thermal contraction that arises between frame 4 and grid plate 5. For example, during the starting operation, frame 4, which has been heated by high-temperature compressed air, can expand (thermal expansion) before grid plate 5. As a result, the guide rollers 7 on the grid plate 5 side are pressed by inner rail 6 which has expanded, and begin to contact excessively to an extent that impedes smooth rotation of grid plate 5.

Furthermore, during a stop in operation, frame 4, which is no longer being exposed to compressed air, cools down and contracts before grid plate 5. As a result, guide rollers 7 cease to be supported by inner rail 6, so that they become loose and rotation becomes unstable.

In addition, when the actuator is operated to force the grid plate to rotate when conditions for its smooth rotation are not present, it is possible to cause deformities in the grid plate.

SUMMARY OF THE INVENTION

The present invention was conceived in view of the above-described circumstances and aims to enable the smooth rotation of the grid plate and the correct operation of the bypass valve, regardless of the operating state of the gas turbine.

In order to resolve the above-described problem, the present invention employs a compressed air bypass valve and gas turbine having the following design.

Namely, the present invention is a bypass valve for diverting a portion of the air which was compressed by a compressor, during the process of guiding this compressed air to a combustion chamber, this bypass valve being characterized in the provision of a frame, which is disposed to cover a plurality of compressed air introduction ports that are arrayed in a ring, and in which there are formed a plurality of first openings that communicate with the combustion chamber tail pipe; a grid plate which has a ring shape identical to that formed by the plurality of combustion chamber tail pipes and in which there are formed a plurality of second openings that are positioned opposite the first openings, this grid plate being supported in a manner to enable rotation in its circumferential direction; an inner rail and an outer rail that are provided to the inside surface and the outside surface of the grid plate and are formed in a unitary manner with the frame; and a plurality of guide rollers that are provided to the grid plate, and that come into contact with either the inner rail or the outer rail depending on the circumstances and assist in the rotation of the grid plate.

In the above-described compressed air bypass valve, it is desirable that when the device is in the state preceding a operation and a bypass operation of compressed air is not performed; there be provided a space interval between both the inner rail and the plurality of guide rollers, and the outer rail and the plurality of guide rollers.

Further, the gas turbine according to the present invention is characterized in the provision of the compressed air bypass valve of the above-described design.

In the present invention, the guide rollers come into contact with either the inner rail or the outer rail depending on the circumstances, and assist in the rotation of the grid plate by turning along either of these rails.

In addition, a space is provided between both the inner rail and the guide rollers and the outer rail and the guide rollers. As a result, during starting operation of the gas turbine, for example, even if the frame expands before the grid plate as a result of its exposure to high temperature compressed air, the diameter of the inner rail also increases as a result of this expansion, causing the space between the inner rail and the guide rollers to disappear. Thus, the inner rail and the guide rollers come into contact without being subjected to an excessive load. Thus, the grid plate turns smoothly along the inner rail. In addition, during a stop in operation, even if the frame cools and contracts faster that the grid plate, the diameter of the outer rail decreases as a result of this contraction, so that the space between the outer rail and the guide rollers disappears. Thus, the outer rail and the guide rollers come into contact with one another without creating excessive play. As a result, the grid plate rotates smoothly along the outer rail.

PREFERRED EMBODIMENTS OF THE INVENTION

Preferred embodiments of the present invention will now be explained with reference to FIGS. 1 through 6.

Figure 1:
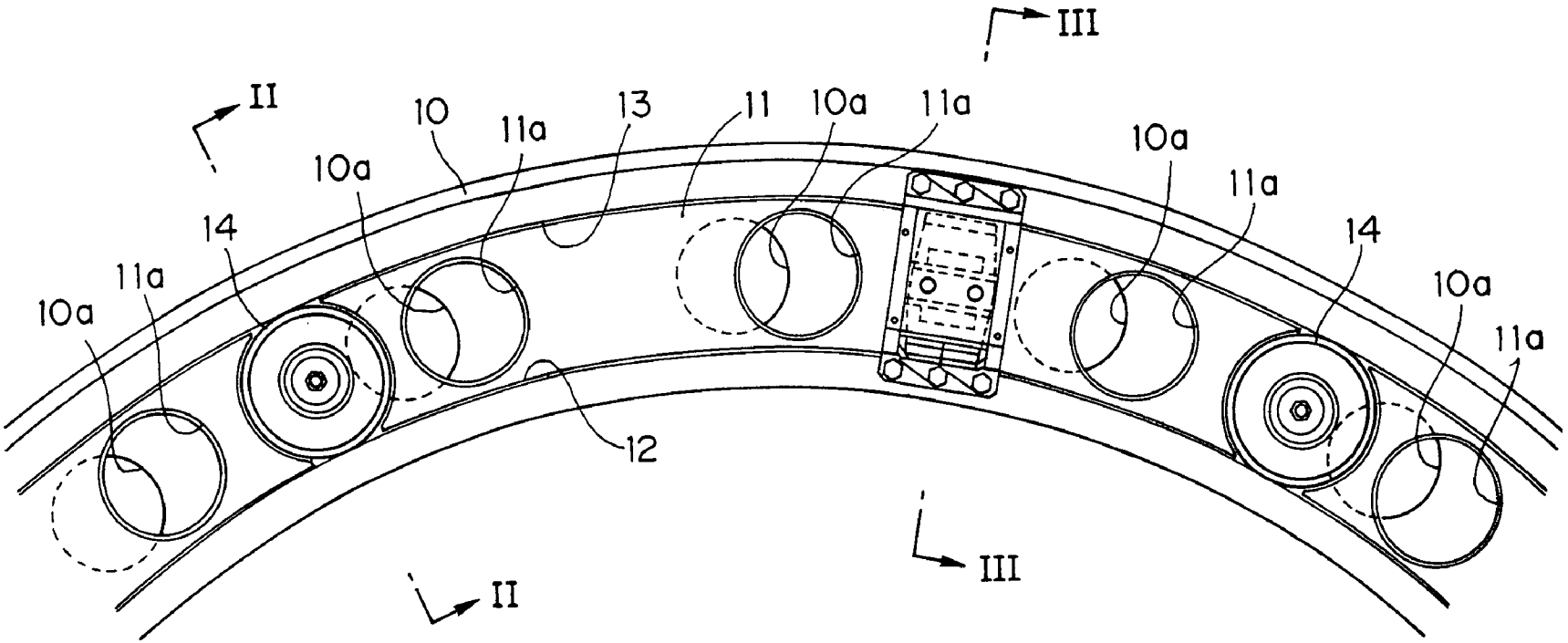
FIG. 1 is a planer view showing an embodiment of the bypass valve according to the present invention, with the portion of the bypass valve that forms a ring shown in detail.

The structure of a bypass valve according to the present invention is shown in FIG. 1. Reference number 10 indicates a frame that is disposed so as to cover the end of compressed air introduction ports that are arrayed in a ring at an interval and form the bypass pipes 2; 11 indicates a grid plate that forms a ring shape that is identical to the array of the bypass pipes 2; 12 is an inner rail that is disposed to the inner periphery of grid plate 11 and is formed in a unitary manner with frame 4; 13 is an outer rail that is disposed to the outer periphery of grid plate 11 and is formed in a unitary manner with frame 10; 14 indicates a plurality of guide rollers that are provided to grid plate 11 and come into contact with either inner rail 12 or outer rail 13, assisting in the rotation of grid plate 11.

A plurality of circular first holes 10*a* are formed in frame 10 communicating with the end of each bypass pipe 2. A plurality of circular second holes 11*a* are formed in grid plate 111 positioned opposite first holes 10*a* and so as to communicate with each of first holes 10*a*.

Figure 2:
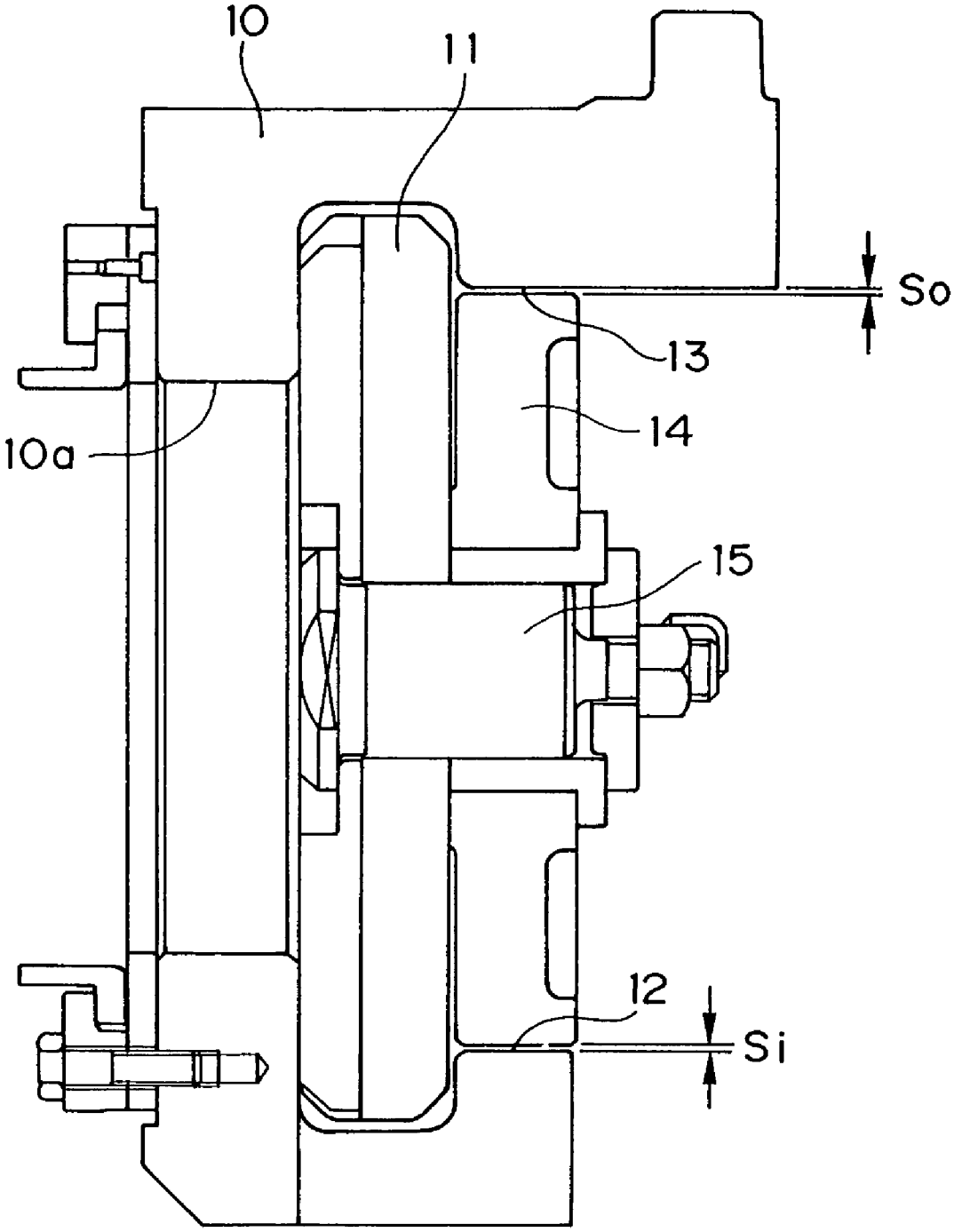
FIG. 2 is a cross-sectional view along the line II-II in FIG. 1.

As shown in FIG. 2, each guide roller 14 is supported in a freely rotational manner by an axis 15 which is installed perpendicular to grid plate 11. In the gas turbine's pre-operational state, space intervals Si and So are provided between inner rail 12 and guide rollers 14, and outer rail 13 and guide rollers 14, respectively.

Figure 3:
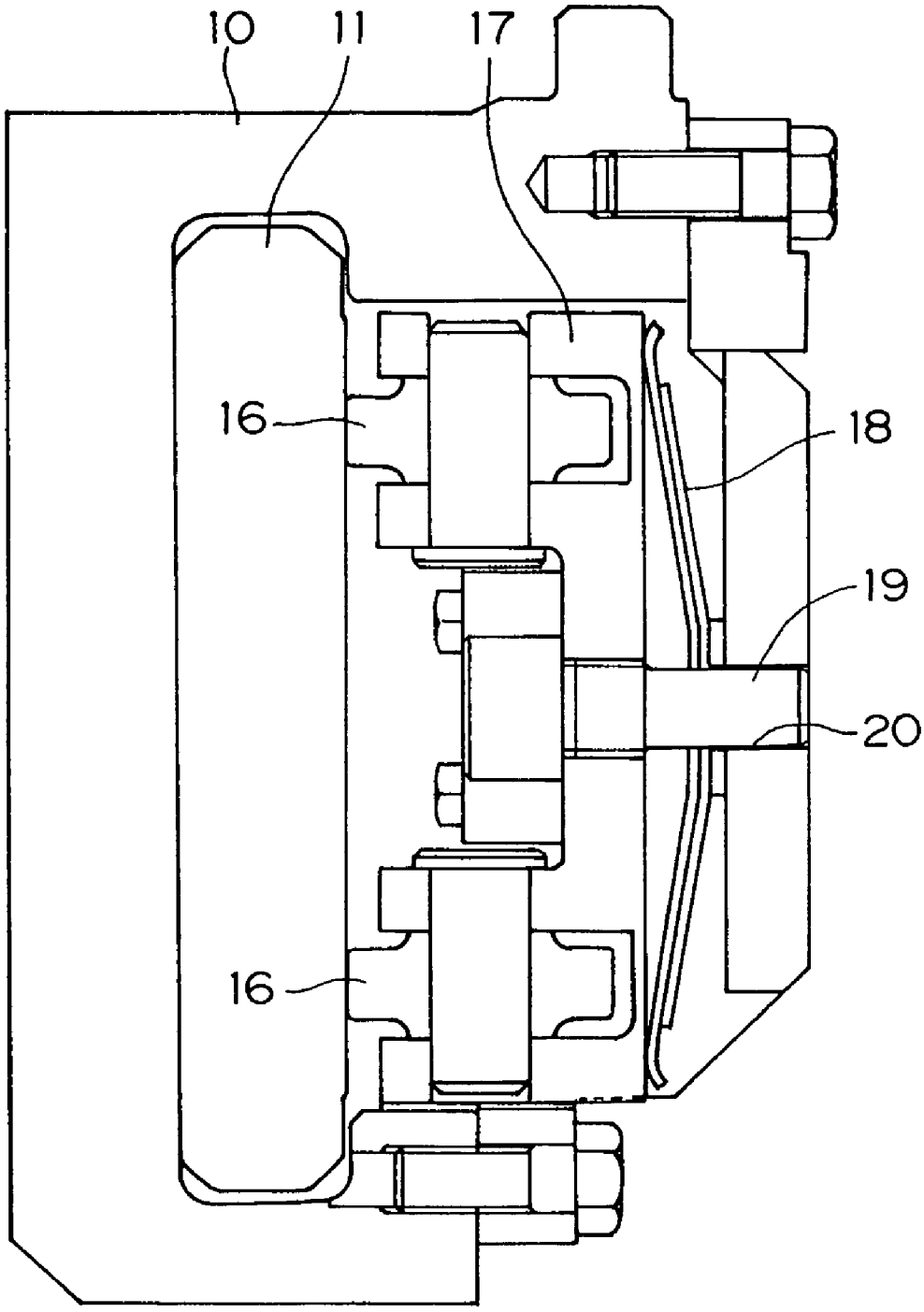
FIG. 3 is a cross-sectional view along the line III-III in FIG. 1.

Grid plate 11 is provided with a mechanism for biasing its plate toward the frame 10 side. As shown in FIG. 3, this biasing mechanism is provided with a base portion 17 that has wheels 16 that come into contact with the side of grid plate 11 that is opposite frame 10 and rotate, permitting the rotation of grid plate 11; plate spring 18 for pressing base portion 17 toward the frame 10 side; a rod-shaped member 19 which is installed in a direction perpendicular to grid plate 11 and which supports base portion 17; and guide hole 20 into which rod-shaped member 19 is inserted and which permits movement of base portion 17 only in the direction perpendicular to grid plate 11. This biasing mechanism is to prevent vibrations effecting grid plate 11 when the opening of the bypass valve is restricted.

The operational state of a bypass valve designed as described above will now be explained separately for starting operation, steady driving operation and stop operation with reference to schematic illustrations.

Figure 4:
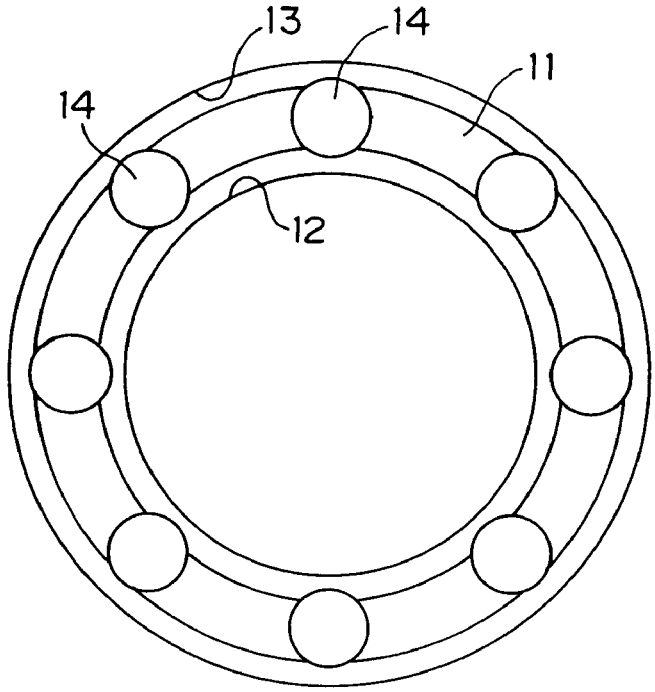
FIG. 4 is an explanatory figure showing the state of the bypass valve prior to starting the gas turbine.

As shown in FIG. 4, during the pre-starting state, when frame 10 (including inner rail 12 and outer rail 13) and grid plate 11 are both cool, space intervals Si, So are present between inner rail 12 and guide rollers 14, and outer rail 13 and guide rollers 14, respectively. Note that grid plate 11 actually hangs downward under its own weight, so that guide rollers 14 come into contact with outer rail 13 on the lower surface of grid plate 111 and come into contact with inner rail 12 on the upper surface of grid plate 11.

Starting Operation

Figure 5:
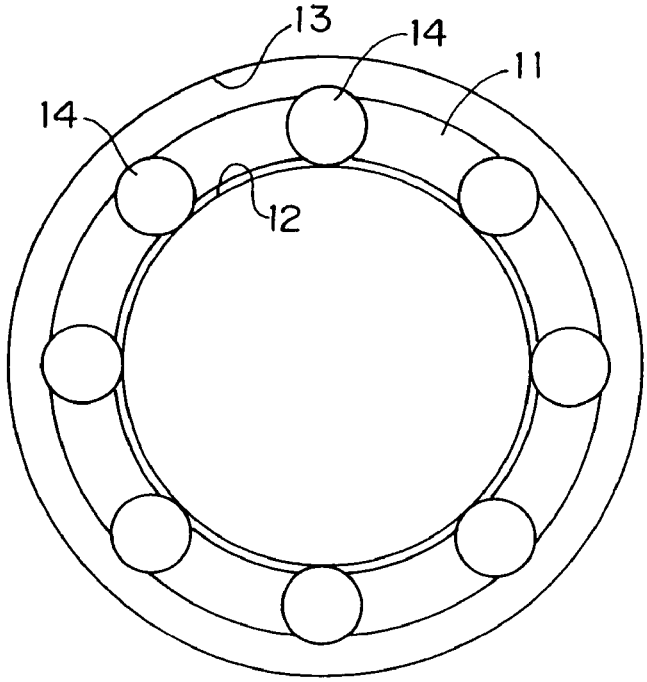
FIG. 5 is an explanatory figure showing the state of the bypass valve during start-up operation of the gas turbine.

When the gas turbine begins to operate, frame 10 and grid plate 11 are both in a cool state, and high-temperature compressed air begins to flow around the bypass valve. Frame 10 is heated by this high-temperature compressed air and expands. As a result, as shown in FIG. 5, the diameter of inner rail 12 increases as a result of the expansion in frame 10, and the space interval Si between inner rail 12 and guide rollers 14 decreases. Since the size of space interval Si is designed in advance after taking into consideration the thermal expansion of frame 10, guide rollers 14 come into contact with inner rail 12 without experiencing excessive load. Accordingly, grid plate 11 rotates smoothly along inner rail 12.

Note that in this case, the diameter of outer rail 13 expands in the same manner as inner rail 12, so that it does not interfere with guide rollers 14 and impede the smooth rotation of grid plate 11.

Steady Driving Operatio

When the gas turbine begins steady operation, both frame 10 and grid plate 11 are heated and begin to expand. As a result, the relationship between inner rail 12 and outer rail 13 and the guide rollers 14 becomes identical to that shown in FIG. 4 (the actual dimensions vary slightly depending on the degree of expansion).

Stop Operation

Figure 6:
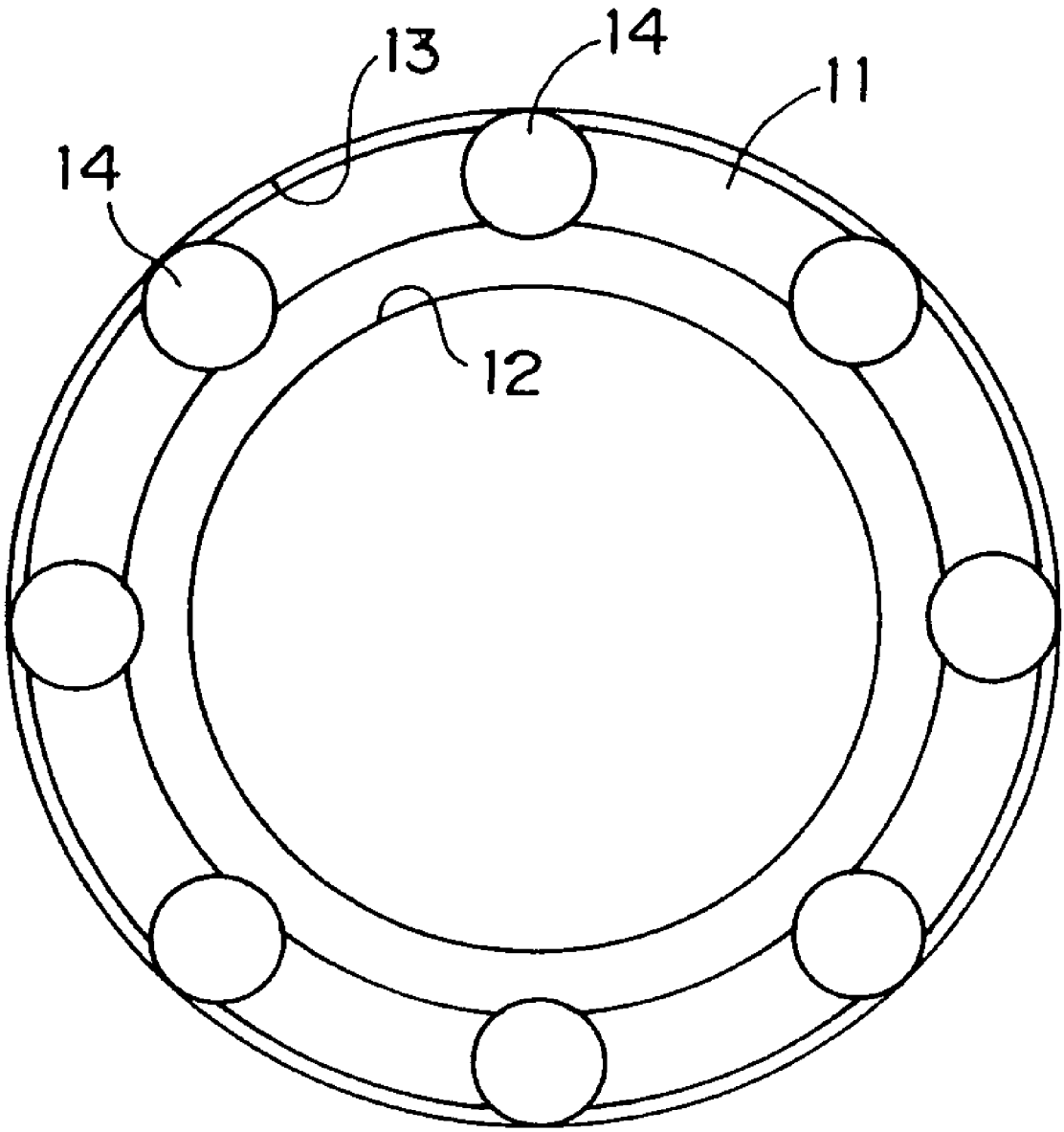
FIG. 6 is an explanatory figure showing the state of the bypass valve during stop operation.
Figure 7:
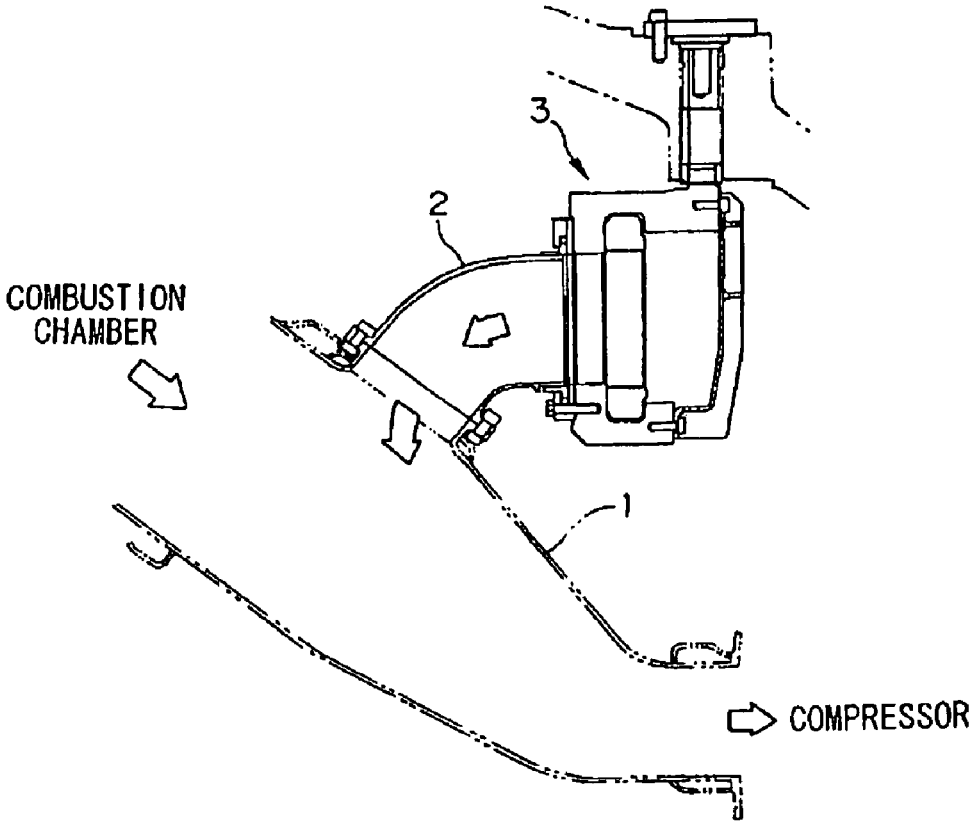
PRIOR ART FIG. 7
FIG. 7 is a side view in cross-section showing a conventional bypass valve and its surrounding structures.
Figure 8:
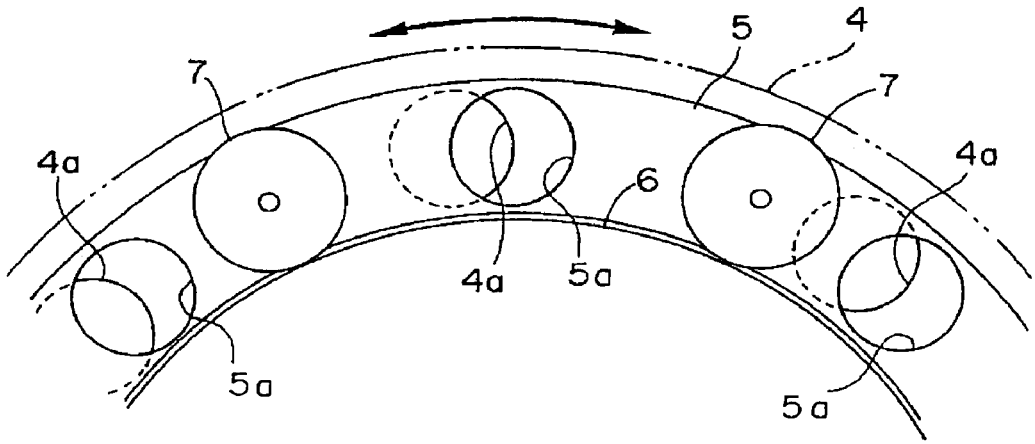
PRIOR ART FIG. 8
FIG. 8 is a planar view schematically showing the structure of the bypass valve.

When output is decreased so as to halt the gas turbine, the amount of compressed air flowing around the bypass valve decreases and the temperature of the air also falls. When this happens, frame 10, which along with grid plate 11 has expanded, begins to cool and contract first. As a result, as shown in FIG. 6, the diameter of outer rail 13 decreases due to this contraction, and the space interval So between outer rail 13 and guide rollers 14 narrows. Since the size of space interval So is designed in advance after taking into consideration the thermal expansion of frame 10, guide rollers 14 come into contact with outer rail 13 without experiencing excessive load. Accordingly, grid plate 11 rotates smoothly along outer rail 13.

Note that in this case, the diameter of inner rail 12 decreases in the same manner as outer rail 13, so that it does not interfere with guide rollers 14 and become an impediment to the smooth rotation of grid plate 11.

Thus, by employing the bypass valve of the above-described design, it is possible to avoid excessive contact between guide rollers 14 and inner rail 12 which previously has been problematic during starting operation. Accordingly, smooth rotation of grid plate 11 is enabled and normal operation of the bypass valve is possible.

In addition, the above-described design stops the problematic loose play that occurred between the guide rollers 14 and outer rail 13 during stop operations. Accordingly, smooth rotation of grid plate 11 is enabled and normal operation of the bypass valve is possible.

What is claimed is:

1. A bypass valve for diverting a portion of air compressed by a compressor, during a process of guiding said compressed air to a combustion chamber, wherein said bypass valve is provided with:

a frame, which is disposed to cover a plurality of compressed air introduction ports that are arrayed in ring, and in which there are formed a plurality of first openings that communicate with a combustion chamber tail pipe;

a grid plate which has a ring shape identical to that formed by the plurality of combustion chamber tail pipes and in which there are formed a plurality of second openings that are positioned opposite said first openings, said grid plate being supported in a manner to enable rotation in its circumferential direction;

an inner rail and an outer rail that are provided to the inside surface and the outside surface of the grid plate and are formed in a unitary manner with said frame; and a plurality of guide rollers that are provided to said grid plate, and that come into contact with either said inner rail or said outer rail depending on circumstances and assist in rotation of said grid plate, wherein in a state where the compressed air does not flow around the bypass valve, a space interval is provided between both said inner rail and said plurality of guide rollers, and between said outer rail and said plurality of guide rollers.

2. A gas turbine equipped with the bypass valve according to claim 1.

3. The bypass valve according to claim 1, wherein the space interval is predetermined in accordance with a thermal expansion of said frame.

4. A gas turbine equipped with the bypass valve according to claim 3.

* * * * *